US009863291B2

(12) United States Patent
Brune

(10) Patent No.: US 9,863,291 B2
(45) Date of Patent: Jan. 9, 2018

(54) LOCATOR FOR USE IN A VALVETRAIN OF A CYLINDER HEAD OF AN INTERNAL COMBUSTION ENGINE

(71) Applicant: GT Technologies, Westland, MI (US)

(72) Inventor: John E. Brune, Stockbridge, MI (US)

(73) Assignee: GT TECHNOLOGIES, Westland, MI (US)

( * ) Notice: Subject to any disclaimer, the term of this patent is extended or adjusted under 35 U.S.C. 154(b) by 68 days.

(21) Appl. No.: 15/153,795

(22) Filed: May 13, 2016

(65) Prior Publication Data

US 2016/0333750 A1 Nov. 17, 2016

Related U.S. Application Data

(60) Provisional application No. 62/161,336, filed on May 14, 2015.

(51) Int. Cl.
*F01L 3/22* (2006.01)
*F01L 1/46* (2006.01)
(Continued)

(52) U.S. Cl.
CPC ..... *F01L 1/462* (2013.01); *F01L 3/10* (2013.01); *F01L 3/08* (2013.01); *F01L 3/22* (2013.01)

(58) Field of Classification Search
CPC ..... F01L 1/462; F01L 3/08; F01L 3/10; F01L 3/22
(Continued)

(56) References Cited

U.S. PATENT DOCUMENTS 1,617,986 A 2/1927 Blank
1,624,497 A 4/1927 McAllister
(Continued)

FOREIGN PATENT DOCUMENTS

CN 201679532 U 12/2010
CN 201858036 U 6/2011
(Continued)

OTHER PUBLICATIONS

Apr. 17, 2015 European Search Report for EP App. No. 14172868.3-1603.
(Continued)

*Primary Examiner* — Jorge Leon, Jr.
(74) *Attorney, Agent, or Firm* — Howard & Howard Attorneys PLLC

(57) ABSTRACT

A locator for use in a valvetrain of a cylinder head of an internal combustion engine having a valve substantially concentrically aligned with both a valve spring and a support, the support at least partially extending into the valve spring. The locator includes an annulus seat that supports the valve spring. The locator further includes a tapered ring operatively attached to the seat that has a tapered inner surface, for at least partially accommodating the support of the valvetrain therein, and a tapered outer surface, for at least partially engaging and concentrically aligning with the valve spring. The locator also includes a plurality of radially-spaced lobes. The lobes are disposed on the inner surface of the ring and at least partially engage the support such that the locator substantially concentrically aligns the valve spring with the valve and the support.

17 Claims, 6 Drawing Sheets

(51) Int. Cl.
*F01L 3/10* (2006.01)
*F01L 3/08* (2006.01)

(58) Field of Classification Search
USPC ..... 123/90.67
See application file for complete search history.

(56) References Cited

U.S. PATENT DOCUMENTS

| | | | | |
|---|---|---|---|---|
| 2,563,699 | A | 8/1951 | Winter, Jr. | |
| 3,002,507 | A | 10/1961 | Bensinger et al. | |
| 3,139,872 | A | 7/1964 | Thompson | |
| 3,166,058 | A | 1/1965 | Zink | |
| 3,633,556 | A * | 1/1972 | Inoue | F01L 1/26 123/193.5 |
| 4,369,740 | A | 1/1983 | Seidl | |
| 4,494,729 | A | 1/1985 | Krueger | |
| 4,497,307 | A | 2/1985 | Paar et al. | |
| 4,539,953 | A | 9/1985 | Sasaki et al. | |
| 4,598,674 | A | 7/1986 | Nono et al. | |
| 4,676,203 | A | 6/1987 | Nouno | |
| 4,919,090 | A * | 4/1990 | Deuring | B23P 19/045 123/188.6 |
| 5,211,143 | A | 5/1993 | Fontichiaro et al. | |
| 5,775,280 | A | 7/1998 | Schmidt et al. | |
| 6,047,675 | A | 4/2000 | Kunz | |
| 6,460,495 | B1 | 10/2002 | Seitz et al. | |
| 6,491,012 | B2 | 12/2002 | Pryba et al. | |
| 6,543,402 | B2 | 4/2003 | Bums | |
| 6,758,180 | B2 | 7/2004 | Pierik | |
| 7,146,950 | B2 | 12/2006 | Moeck et al. | |
| 7,350,490 | B2 | 4/2008 | Mock et al. | |
| 7,721,695 | B2 | 5/2010 | Moeck et al. | |
| D679,732 | S * | 4/2013 | Edgar | D15/5 |
| 2005/0211206 | A1 | 9/2005 | Ruggiero et al. | |
| 2010/0242878 | A1 | 9/2010 | Maekawa | |
| 2012/0260874 | A1 | 10/2012 | Moeck et al. | |
| 2015/0240744 | A1 * | 8/2015 | Marrocco | B23P 19/045 29/888.06 |
| 2016/0061062 | A1 | 3/2016 | Brune | |

FOREIGN PATENT DOCUMENTS

| | | | |
|---|---|---|---|
| DE | 482512 | C | 9/1929 |
| DE | 3500524 | A1 | 7/1985 |
| DE | 102005036918 | A1 | 2/2007 |
| DE | 102008025034 | A1 | 11/2009 |
| DE | 102008029293 | A1 | 12/2009 |
| DE | 102008048515 | A1 | 3/2010 |
| DE | 102008052280 | A1 | 4/2010 |
| EP | 2213849 | A1 | 8/2010 |
| EP | 2233704 | A1 | 9/2010 |
| EP | 2662541 | A1 | 11/2013 |
| GB | 928585 | A | 6/1963 |
| JP | 6088809 | A | 5/1985 |
| JP | 201059926 | A | 3/2010 |
| WO | 00/20730 | A1 | 4/2000 |
| WO | 2005/028816 | A1 | 3/2005 |
| WO | 2009084598 | A1 | 7/2009 |
| WO | 2009/154621 | A1 | 12/2009 |
| WO | 2012095203 | A1 | 7/2012 |
| WO | 2013020358 | A1 | 2/2013 |

OTHER PUBLICATIONS

Communication dated Jan. 22, 2016 enclosing the Extended European Search Report dated Jan. 15, 2016 for European Application No. 15183665.7.

* cited by examiner

LOCATOR FOR USE IN A VALVETRAIN OF A CYLINDER HEAD OF AN INTERNAL COMBUSTION ENGINE

CROSS REFERENCE TO RELATED APPLICATIONS

This application claims the benefit of U.S. provisional patent application entitled "Locator for Use in a Valvetrain of a Cylinder Head of an Internal Combustion Engine," having Ser. No. 62/161,336, and filed on May 14, 2015.

BACKGROUND OF THE INVENTION

1. Field of Invention

The present invention relates, generally, to engine valvetrain systems and, more specifically, to a locator for use in a valvetrain of a cylinder head of an internal combustion engine.

2. Description of the Related Art

Conventional engine valvetrain systems known in the art typically include one or more camshafts in rotational communication with a crankshaft supported in a block, one or more intake and exhaust valves supported in a cylinder head, and one or more intermediate members for translating radial movement from the camshaft into linear movement of the valves. The valves are used to regulate the flow of gasses in and out of cylinders of the block. To that end, the valves have a head and a stem extending therefrom. The valve head is configured to periodically seal against the cylinder head. The valve stem is engaged by the intermediate member so as to open and close the valve as the camshaft rotates.

The valve stem is typically supported by a valve guide that is operatively attached to the cylinder head. The stem extends through the valve guide and travels therealong in response to engagement from the intermediate member. To seal the valve head against the cylinder head, a compression spring is disposed about the valve stem in the cylinder head. The spring has a bottom and a top. The bottom of the spring engages a valve seat which, in turn, engages the cylinder head adjacent the valve guide. The valve seat is frequently manufactured from a material that is harder than that of the cylinder head and/or valve guide, so as to decrease engine wear. The top of the spring engages a retainer that is operatively attached to the valve stem. The spring is movable between two different compressed positions, commonly referred to as "valve open" and "valve closed". In the valve closed position, potential energy from the loaded spring holds the valve head sealed against the cylinder head. In the valve opened position, rotation from the camshaft translates linear movement to the valve stem via the intermediate member, which compresses the spring and un-seals the valve head from the cylinder head, thereby allowing gasses to flow into the cylinder of the block.

Typically, the valve, valve guide, seat, and spring are concentrically aligned with each other so as to promote even loading to the valve stem. In operation, and particularly at high engine rotational speeds, the spring may rotate and/or move out of concentricity with the valve stem, leading to uneven loading. Such movement of the valve spring is detrimental to engine performance, as uneven loading may result in high-speed "valve float," whereby the spring is consequently unable to properly seal the valve head against the cylinder head. Moreover, as the spring moves, it may wear against or otherwise engage other valvetrain components, such as parts of the cylinder head, the valve guide, etc., which leads to decreased engine life.

Each of the components of an engine valvetrain system of the type described above must cooperate to effectively translate movement from the camshaft so as to operate the valves properly at a variety of engine rotational speeds. In addition, each of the components must be designed not only to facilitate improved performance and efficiency, but also so as to reduce the cost and complexity of manufacturing and assembling the valvetrain system, as well as reduce wear in operation. While engine valvetrain systems known in the related art have generally performed well for their intended purpose, there remains a need in the art for an engine valvetrain system that has superior operational characteristics, and, at the same time, reduces the cost and complexity of manufacturing the components of the system.

SUMMARY OF THE INVENTION

The present invention overcomes the disadvantages in the related art in a locator for use in a valvetrain of a cylinder head of an internal combustion engine. The valvetrain includes a valve substantially concentrically aligned with both a valve spring and a support, the support at least partially extending into the valve spring. The locator includes an annulus seat that supports the valve spring. The locator further includes a tapered ring operatively attached to the seat and that has a tapered inner surface, for at least partially accommodating the support of the valvetrain therein, and a tapered outer surface, for at least partially engaging and concentrically aligning with the valve spring. The locator also includes a plurality of radially-spaced lobes. The lobes are disposed on the inner surface of the ring and at least partially engage the support such that the locator substantially concentrically aligns the valve spring with the valve and the support.

In this way, the present invention significantly reduces the complexity and packaging size of the valvetrain system and its associated components. Moreover, the present invention reduces the cost of manufacturing valvetrain systems that have superior operational characteristics, such as improved engine performance, control, lubrication, efficiency, as well as reduced vibration, noise generation, engine wear, and packaging size.

BRIEF DESCRIPTION OF THE DRAWINGS

Other objects, features, and advantages of the present invention will be readily appreciated as the same becomes better understood after reading the subsequent description taken in connection with the accompanying drawing wherein.

DETAILED DESCRIPTION OF THE INVENTION

Figure 1:
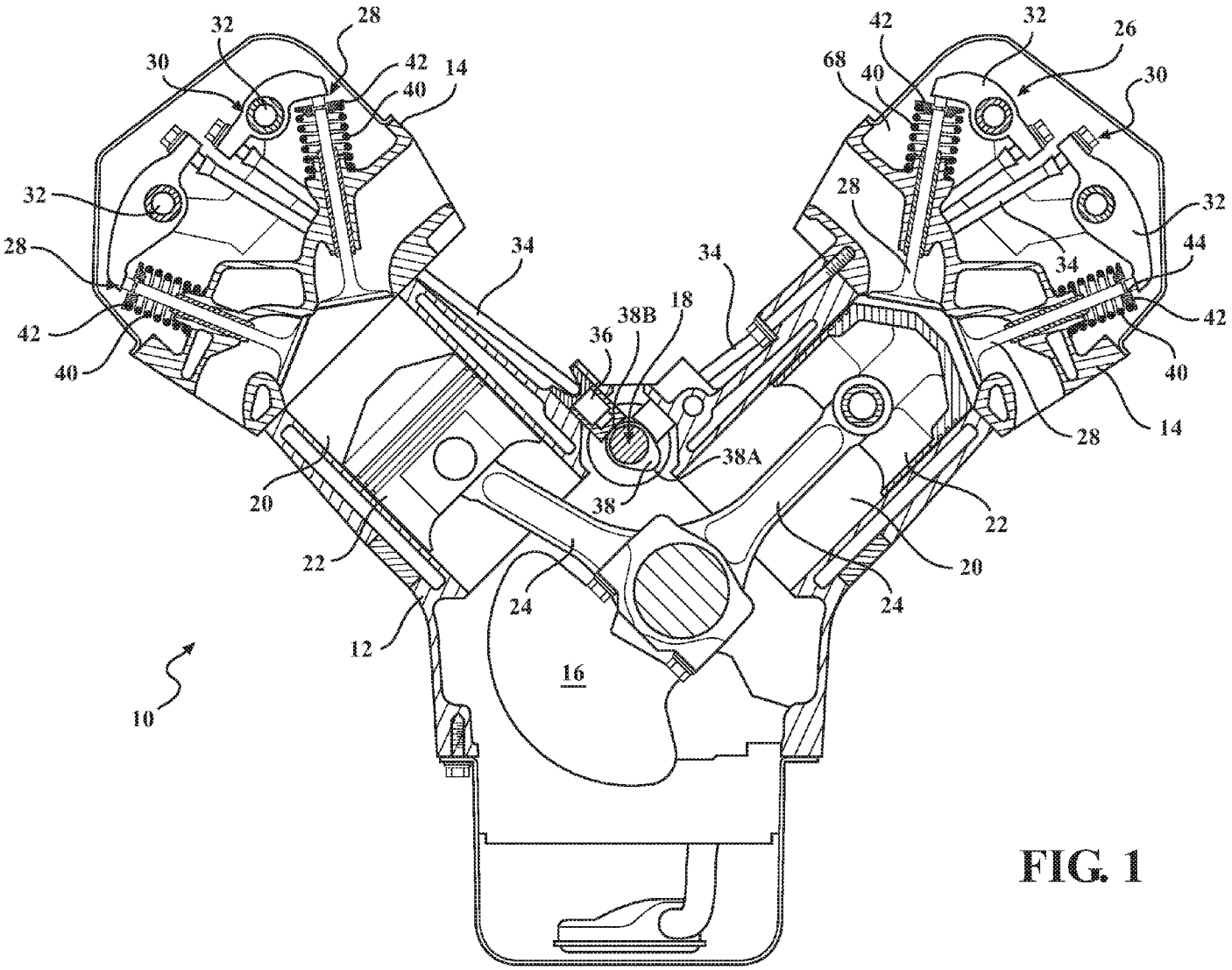
FIG. 1 is a partial front sectional view of an automotive engine with a cam-in-block configuration, showing a pair of cylinder heads with valves and springs disposed therein.

Referring now to the drawings, where like numerals are used to designate like structure, a portion of an internal combustion engine is illustrated at 10 in FIG. 1. The engine 10 includes a block 12 and one or more cylinder heads 14 mounted to the block 12. A crankshaft 16 is rotatably supported in the block 12, and a camshaft 18 is rotatably supported in the block 12 spaced from the crankshaft 16. The crankshaft 16 drives the camshaft 18 via a timing chain or belt (not shown, but generally known in the art). The block 12 typically includes one or more cylinders 20 in which a piston 22 is supported for reciprocal motion therealong. The piston 22 is pivotally connected to a connecting rod 24, which is also connected to the crankshaft 16. In operation, combustion in the cylinders 20 of the engine 10 moves the pistons 22 in reciprocal fashion within the cylinders 20. Reciprocal motion of the piston 22 generates rotational torque that is subsequently translated by the crankshaft 16 to the camshaft 18 which, in turn, cooperates with a valvetrain, generally indicated at 26, to control the flow and timing of intake and exhaust gasses between the cylinder heads 14, the cylinders 20, and the outside environment. Specifically, the camshaft 18 controls what is commonly referred to in the art as "valve events," whereby the camshaft 18 effectively actuates valves 28 supported in the cylinder head 14 at specific time intervals with respect to the rotational position of the crankshaft 16, so as to effect a complete thermodynamic cycle of the engine 10.

While the engine 10 illustrated in FIG. 1 is a V-configured, cam-in-block, overhead-valve, pushrod-actuated, spark-ignition, Otto-cycle engine, those having ordinary skill in the art will appreciate that the engine 10 could be of any suitable configuration, with any suitable number of camshafts 18 disposed in any suitable way, controlled using any suitable thermodynamic cycle, and with any suitable type of valvetrain 26, without departing from the scope of the present invention. Further, while the engine 10 is configured for use with automotive vehicles, those having ordinary skill in the art will appreciate that the present invention could be used in any suitable type of engine 10. By way of non-limiting example, the present invention could be used in connection with passenger or commercial vehicles, motorcycles, all-terrain vehicles, lawn care equipment, heavy-duty trucks, trains, airplanes, ships, construction vehicles and equipment, military vehicles, or any other suitable application without departing from the scope of the present invention.

The camshaft 18 cooperates with the valvetrain 26 to translate radial movement from the camshaft 18 into linear movement of the valves 28 to control the valve events, as discussed above. More specifically, the valvetrain 26 is used to translate force between the camshaft 18, one or more intermediate members (generally indicated at 30), and the valves 28. In the representative embodiment illustrated herein, the intermediate member 30 is realized by a plurality of components, including a rocker arm assembly, generally indicated at 32, a pushrod 34, and a hydraulic lash adjuster 36 (not shown in detail, but generally known in the art). Those having ordinary skill in the art will recognize these as components of what is sometimes referred to as a "cam-in-block" engine 10, whereby rotation of the camshaft 18 is translated to the hydraulic lash adjuster 36, which engages the pushrod 34, which engages the rocker arm assembly 32, which correspondingly engages the valve 28. However, as will be appreciated from the description of the present invention below, the valvetrain 26 could be configured in any suitable way, with any suitable type or number of intermediate members 30, without departing from the scope of the present invention. By way of non-limiting example, the valvetrain 26 could be designed so as to cooperate with multiple camshafts 18 disposed in the cylinder heads 14 as opposed to in the block 12 (commonly referred to as an "overhead cam" arrangement).

The camshaft 18 includes a plurality of what are typically egg-shaped lobes 38 that each have a high point 38A and a low point 38B corresponding to opening and closing of the valve 28, respectively. The valve 28 opens when the camshaft 18 rotates such that the high point 38A of the lobe 38 engages the intermediate member 30. As the camshaft 18 rotates further, the valve 28 subsequently closes again, following the profile of the lobe 38 away from the high point 38A and toward the low point 38B. To aid in closing the valve 28, a compression spring 40 is typically disposed around the valve 28, supported in the cylinder head 14, and operatively attached to the valve 28, as described in greater detail below. As the valve 28 opens, the valve spring 40 compresses against the cylinder head 14 and stores potential energy. As the camshaft 18 continues to rotate, and as the low point 38B engages the intermediate member 30, the potential energy stored in the valve spring 40 is released, thereby closing the valve 28 in response. While a single valve spring 40 is illustrated as being allocated for each valve 28, those having ordinary skill in the art will appreciate that more than one valve spring 40 could be allocated for a single valve 28 without departing from the scope of the present invention. By way of non-limiting example, a "dual" or "triple" assembly of nested valve springs 40 and/or dampers (not shown, but generally known in the art) could be used. Moreover, while the valve spring 40 is a straight-cylindrical compression spring manufactured from round wire, those having ordinary skill in the art will appreciate that the valve spring 40 could be of any suitable shape, size, or configuration, with any suitable wire size or cross-sectional shape, without departing from the scope of the present invention. By way of non-limiting example, a valve spring 40 with a "bee-hive" profile made from wire with an ovate cross section could be used.

The valvetrain 26 also typically includes a retainer 42, keepers 44, and a valve guide 46 that cooperate with the cylinder head 14, camshaft 18, valve 28, and valve spring 40, as described in greater detail below.

Figure 2:
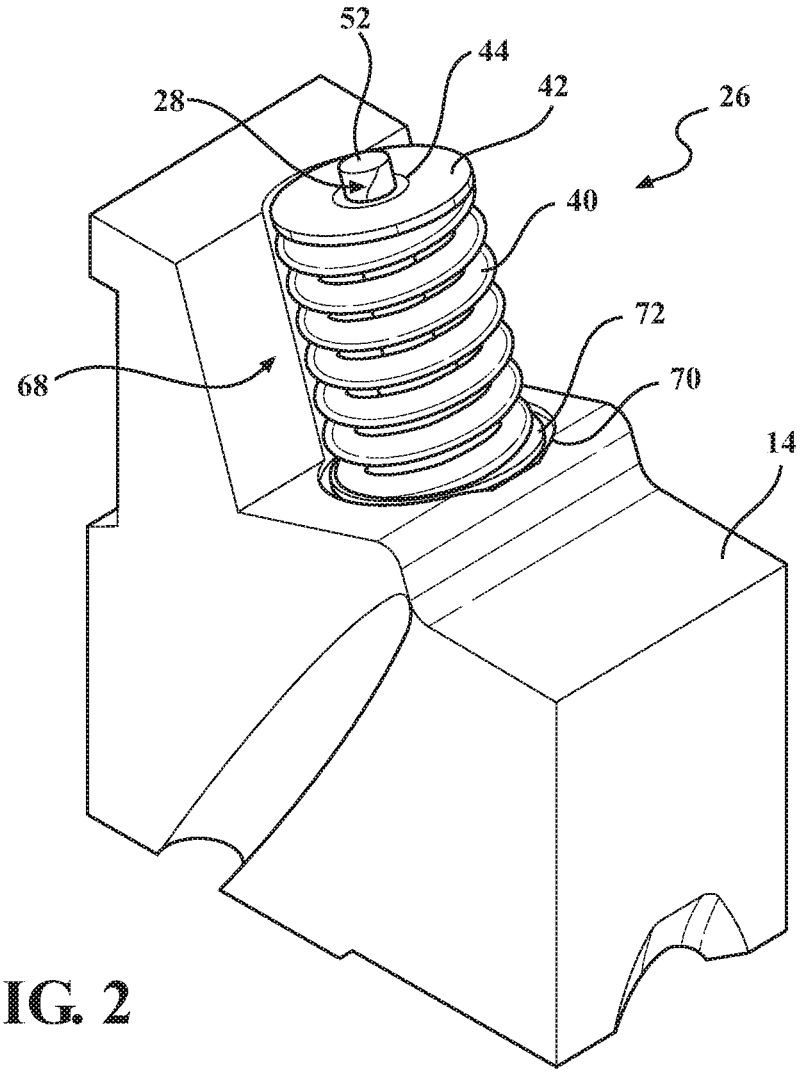
FIG. 2 is a partial perspective view of a portion of a valvetrain of one of the cylinder heads of FIG. 1, showing a valve, valve spring, retainer, keepers, and a locator, according to one embodiment of the present invention.
Figure 3:
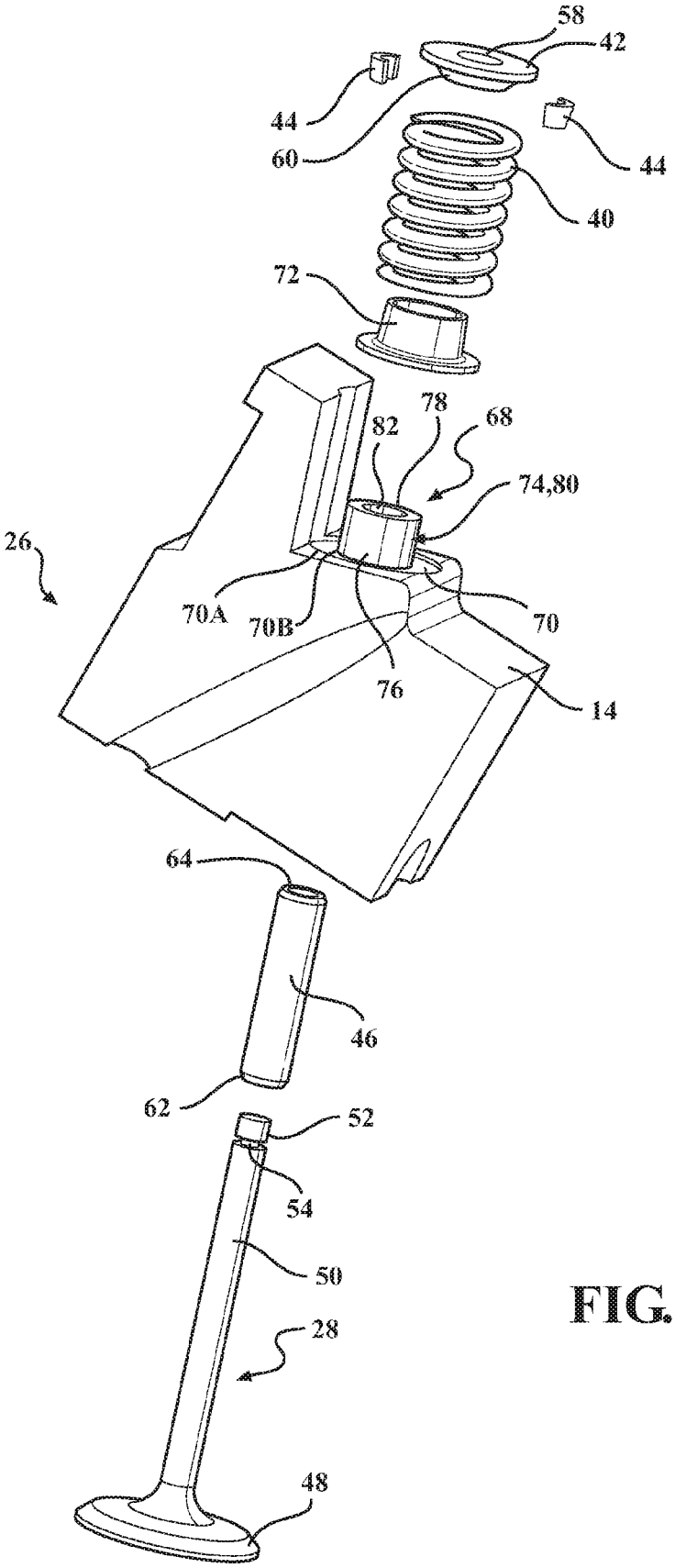
FIG. 3 is exploded perspective view of the valvetrain of FIG. 2.
Figure 4:
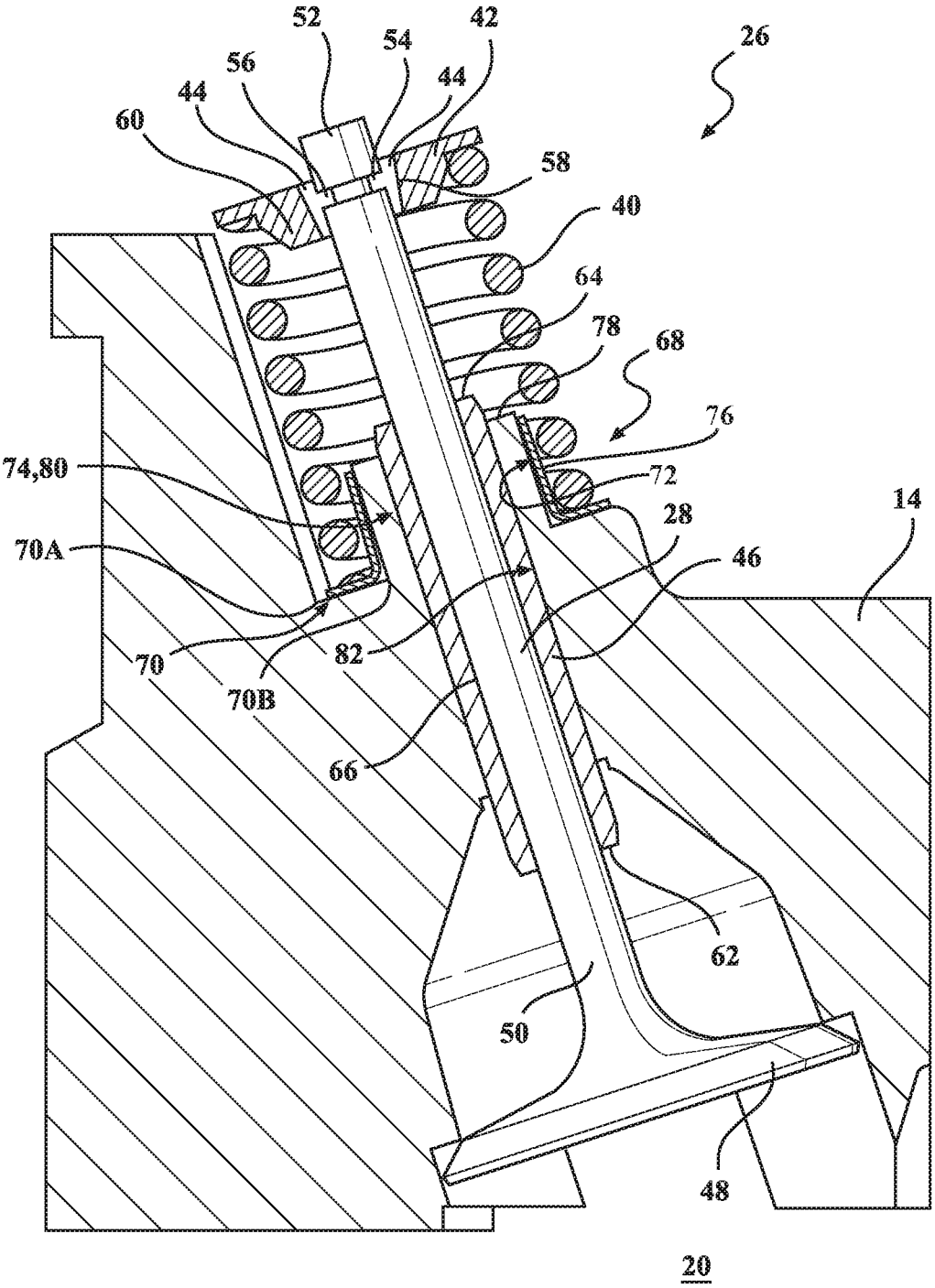
FIG. 4 is a sectional view taken along line 4-4 of FIG. 2.

Referring now to FIGS. 2-4, the valve 28 has a head 48 and a stem 50 extending from the head 48. The head 48 of the valve 28 is disposed within the cylinder 20 of the block 12 and is configured to seal against the cylinder head 14 and periodically open in response to rotation of the camshaft 18, as discussed above. The stem 50 of the valve 28 extends to a valve end 52, which is engaged by the intermediate member 30. Adjacent to the valve end 52, the valve 28 has a groove 54 that cooperates with the keepers 44 and retainer 42 so as to couple the valve 28 to the valve spring 40. To that end, the keepers 44 each include a ridge 56 that engages the groove 54 of the valve 28 so as to axially align the keepers 44 with the valve 28. While a single groove 54 and corresponding ridge 56 are shown herein, those having ordinary skill in the art will appreciate that any suitable number of grooves 54 and/or ridges 56 could be used without departing from the scope of the present invention.

As shown best in FIG. 4, the keepers 44 have a tapered profile that cooperates with a complimentarily tapered aperture 58 defined in the retainer 42. The retainer 42 is typically concentrically aligned with and engages the valve spring 40. The valve spring 40 is installed into the cylinder head 14 in a partially compressed fashion and, thus, pushes against the retainer 42, which correspondingly translates force to the valve 28 via the keepers 44. The retainer 42 may also include a lower taper 60 used to substantially concentrically align the valve spring 40 and retainer 42 with the valve 28.

As noted above, the valvetrain 26 also includes a valve guide 46 operatively attached to the cylinder head 14. The valve guide 46 extends between a first guide end 62disposed adjacent to the cylinder 20, and a second guide end 64 disposed adjacent to the valve spring 40. The valve guide 46 has a substantially tube-shaped profile defining an inner bore 66. The stem 50 of the valve 28 is disposed within and travels along the inner bore 66 of the valve guide 46 in response to rotation of the camshaft 18, as discussed above. Those having ordinary skill in the art will appreciate that the valve 28 is typically manufactured from a hard material, such as a steel alloy, and the valve guide 46 is typically manufactured from a softer material, such as brass, so as to reduce friction and prevent engine 10 wear in operation.

The second guide end 64 of the valve guide 46 typically extends into a pocket 68 of the cylinder head 14 defined where the valve spring 40 is disposed. The pocket 68 accommodates the valve spring 40, retainer 42, keepers 44, and a portion of the valve 28. Adjacent to the pocket 68, the cylinder head 14 includes a rest surface 70 disposed below the valve spring 40. The rest surface 70 of the cylinder head 14 cooperates with a locator 72, according to the present invention, to support and align the valve spring 40, as described in greater detail below.

As shown best in FIG. 3, the rest surface 70 is a substantially ring-shape surface that is sized to accommodate the valve spring 40. More specifically, the rest surface 70 has an outer diameter 70A that is larger than an outer diameter of the spring 40, and an inner diameter 70B that is smaller than an inner diameter of the spring 40 (see FIG. 4).

The valvetrain 26 also includes a support 74 disposed adjacent to the rest surface 70 that cooperates with the locator 72, as described in greater detail below. The support 74 has a substantially cylindrical outer surface 76 and extends at least partially into the valve spring 40 to a support end 78. In the embodiment illustrated throughout the figures, the support 74 is realized as a boss 80 of the cylinder head 14 which extends into the pocket 68. The boss 80 has a boss bore 82 defined therein. The boss bore 82 is concentrically aligned with the outer surface 76 and supports the valve guide 46.

As illustrated in FIG. 4, the second guide end 64 of the valve guide 46 extends further into the valve spring 40 than the support end 78 of the support 74. However, those having ordinary skill in the art will appreciate that the valve guide 46 and boss 80 could be configured in any suitable way without departing from the scope of the present invention. Moreover, while the support 74 is illustrated throughout the figures as a boss 80 of the cylinder head 14 that extends into the pocket 68, it will be appreciated that support 74 could be configured in any way suitable to be substantially concentrically aligned with and extend at least partially into the valve spring 40, without departing from the scope of the present invention. By way of non-limiting example, it is conceivable that the boss 80 could be omitted entirely, whereby the support 74 would then be realized by the valve guide 46 extending at least partially into and substantially concentrically aligned with the valve spring 40.

As noted above, the valvetrain 26 includes a locator 72, according to the present invention. The locator 72 has an annulus seat 84, a tapered ring 86, and a plurality of radially-spaced lobes 88. Each of these components will be described in greater detail below.

Figure 5:
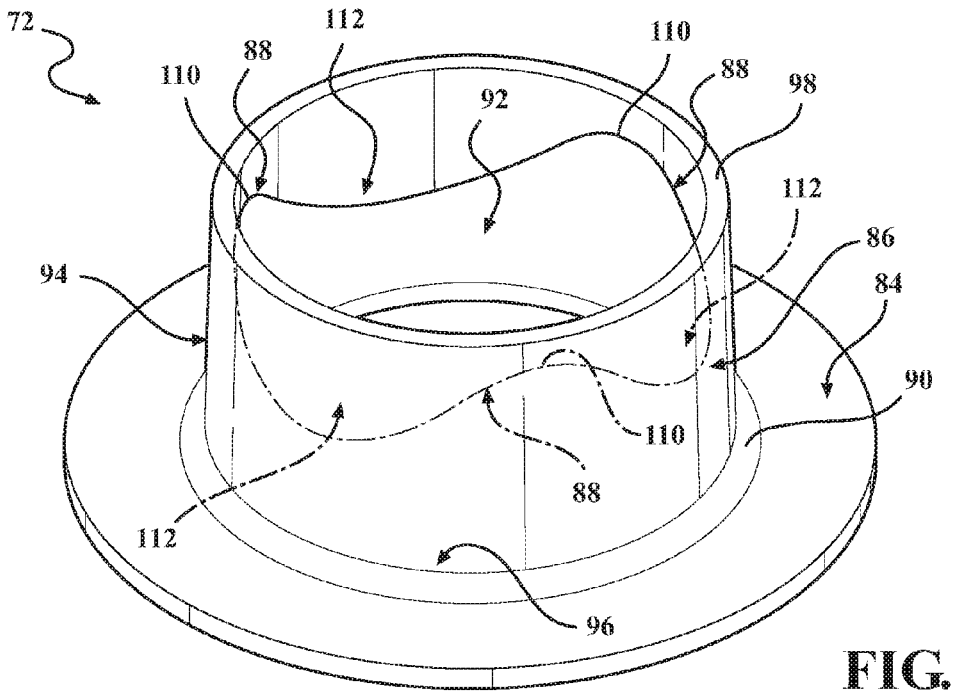
FIG. 5 is an enlarged perspective view of the locator of FIGS. 2-5 having a plurality of inner lobes partially shown in phantom.
Figure 6:
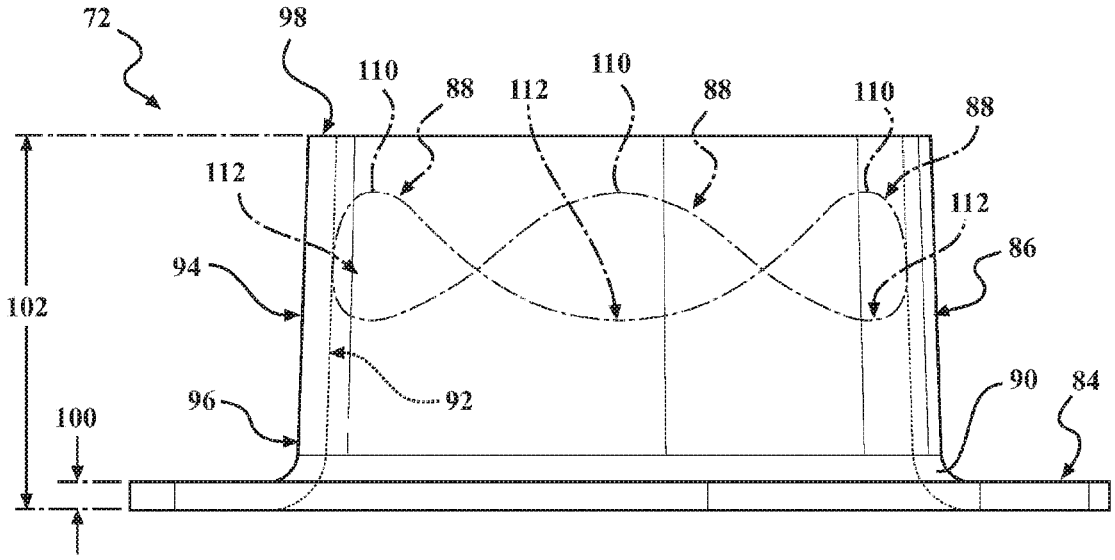
FIG. 6 is a front side plan view of the locator of FIG. 5 with the inner lobes and other interior features shown in phantom.
Figure 7:
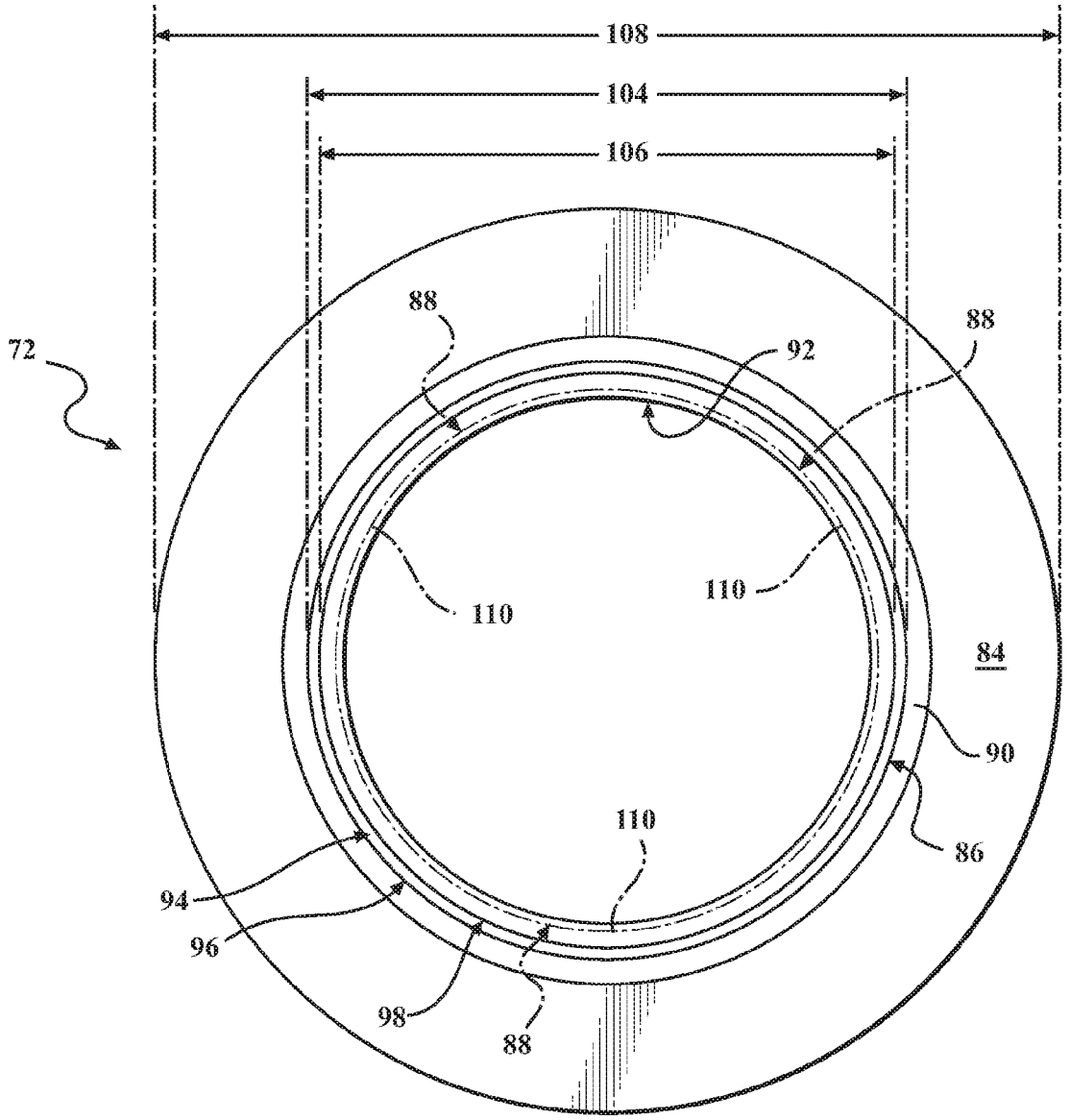
FIG. 7 is a top plan view of the locator of FIG. 5 with the inner lobes shown in phantom.

Referring now to FIGS. 5-7, the seat 84 of the locator 72 supports the valve spring 40. More specifically, the seat 84 is disposed between the valve spring 40 and the rest surface 70 of the cylinder head 14. Those having ordinary skill in the art will appreciate that modern cylinder heads 14 are typically manufactured from aluminum and valve springs 40 are manufactured from high-hardness steel alloys. To prevent wear and distortion to the rest surface 70 of the cylinder head 14 otherwise caused by force translated from the valve spring 40, the seat 84 of the locator 72 is manufactured from a material having a higher hardness than that of the cylinder head 14. To that end, and by way of non-limiting example, the seat 84 may be manufactured from a steel alloy.

The seat 84 of the locator 72 is operatively attached to the ring 86. Advantageously, the locator 72 of the present invention may be manufactured as a unitary component, such as by a drawing process. However, those having ordinary skill in the art will appreciate that the locator 72 could be manufactured in any suitable way sufficient to operatively attach the seat 84 and ring 86 without departing from the scope of the present invention. In one embodiment, the locator 72 includes a transition portion 90 extending between and merging the seat 84 with the ring 86.

As shown best in FIG. 6, the ring 86 has a tapered inner surface 92 and a tapered outer surface 94. The tapered inner surface 92 cooperates with and at least partially accommodates the support 74 therein, as described in greater detail below. The ring 86 extends from a first ring end 96, disposed adjacent to the seat 84, to a second ring end 98 spaced from the seat 84. The tapered outer surface 94 at least partially engages and concentrically aligns with the valve spring 40. To that end, the tapered outer surface 94 at the first ring end 96 is sized to the inner diameter of the valve spring 40.

As noted above, the locator 72 may be manufactured as a unitary component. Thus, in one embodiment, the seat 84 has a thickness 100 that is substantially the same as the distance between the tapered inner surface 92 and the tapered outer surface 94 of the ring 86. Moreover, in one embodiment, a total locator height 102 measured between the seat 84 and the second ring end 98 of the ring 86 is at least ten times greater than the thickness 100 of the seat 84. In the representative embodiment illustrated in, the total locator height 102 is approximately fourteen times greater than the thickness 100 of the seat.

The first ring end 96 has a first outer diameter 104 and the second ring end 98 has a second outer diameter 106. Similarly, the seat 84 has a seat outer diameter 108. In one embodiment, the seat outer diameter 108 is greater than either of the first outer diameter 104 and the second outer diameter 106 of the ring 86. Moreover, the seat outer diameter 108 is sized to the outer diameter of the valve spring 40 so as to ensure proper functionality of the valve spring 40 in operation. In one embodiment, the first outer diameter 104 of the ring 86 is at least 1.03 times greater than the second outer diameter 106 of the ring 86. Similarly, in one embodiment, the seat outer diameter 108 of the seat 84 is at least 1.5 times greater than first outer diameter 104 of the ring.

As noted above, the locator 72 of the present invention includes a plurality of radially-spaced lobes 88. As shown best in FIG. 5, the lobes 88 are disposed on the inner surface 92 of the ring 86. The lobes 88 are configured to at least partially engage the support 74 of the valvetrain 26 such that the locator 72 substantially concentrically aligns the valve spring 40 with the valve 28 and the support 74. The locator 72 includes three lobes 88 spaced radially and equidistant relative to each other. However, those having ordinary skill in the art will appreciate that any suitable number of lobes 88 could be employed, without departing from the scope of the present invention.

The lobes 88 have a tapered, substantially arc-shaped profile, with an apex 110 spaced between the first ring end 96 and the second ring end 98 of the ring 86. The apexes 110 of the lobes 88 are spaced closer to the second ring end 98 than to the first ring end 96. At least one of the apexes 110 engages the support 74 of the valvetrain 26. To that end, the lobes 88 each extend toward each other from the inner surface 92 of the ring 86 (see FIG. 7) and define corresponding recesses 112 therebetween (see FIG. 5).

In this way, the present invention significantly reduces the cost and complexity of manufacturing and assembling the valvetrain 26 and associated components. Specifically, it will be appreciated that the spacing and configuration of the lobes 88 enables consistent and simple installation of the locator 72 onto the support 74 and, at the same time, significantly minimizes or otherwise prevents relative rotation of the valve spring 40 and/or locator 72 about the support 74 while optimizing and maintaining concentricity in operation. Thus, the locator 72 of the present invention affords superior engine 10 operational characteristics, such as improved performance, component life and longevity, efficiency, weight, load and stress capability, and packaging orientation.

The invention has been described in an illustrative manner. It is to be understood that the terminology which has been used is intended to be in the nature of words of description rather than of limitation. Many modifications and variations of the invention are possible in light of the above teachings. Therefore, within the scope of the appended claims, the invention may be practiced other than as specifically described.

What is claimed is:

1. A locator for use in a valvetrain of a cylinder head of an internal combustion engine, the valvetrain having a valve substantially concentrically aligned with both a valve spring and a support, the support at least partially extending into the valve spring, said locator comprising:

an annulus seat for supporting the valve spring;

a tapered ring operatively attached to said annulus seat and having a tapered inner surface for at least partially accommodating the support therein, and a tapered outer surface for at least partially engaging and concentrically aligning with the valve spring; and a plurality of radially-spaced lobes disposed on said inner surface of said ring for at least partially engaging the support such that said locator substantially concentrically aligns the valve spring with the valve and the support.

2. The locator as set forth in claim 1, wherein said annulus seat has a thickness, and wherein a total locator height measured between said seat and said ring is at least ten times greater than said thickness.

3. The locator as set forth in claim 1, further including a transition portion extending between and merging said annulus seat with said ring.

4. The locator as set forth in claim 1, wherein said ring extends from a first end disposed adjacent to said annulus seat to a second end spaced from said annulus seat.

5. The locator as set forth in claim 4, wherein said first end has a first outer diameter, said second end has a second outer diameter, and said annulus seat has a seat outer diameter that is greater than either of said first outer diameter and said second outer diameter of said ring.

6. The locator as set forth in claim 5, wherein said first outer diameter is at least 1.03 times greater than said second outer diameter.

7. The locator as set forth in claim 5, wherein said seat outer diameter is at least 1.5 times greater than said first outer diameter of said ring.

8. The locator as set forth in claim 4, wherein said plurality of lobes each have an apex spaced between said first end and said second end of said ring.

9. The locator as set forth in claim 8, wherein said apexes of said plurality of lobes are closer to said second end of said ring than to said first end.

10. The locator as set forth in claim 8, wherein at least one of said apexes engages the support.

11. The locator as set forth in claim 1, including three lobes spaced radially and equidistant relative to each other.

12. The locator as set forth in claim 1, wherein said plurality of lobes has a substantially arc-shaped profile.

13. The locator as set forth in claim 1, wherein said plurality of lobes extends toward each other from said inner surface of said ring.

14. The locator as set forth in claim 1, wherein said plurality of lobes defines corresponding recesses therebetween.

15. The locator as set forth in claim 1, wherein the support is further defined as a valve guide having a substantially cylindrical profile.

16. The locator as set forth in claim 1, wherein the support is further defined as a cylinder head boss having a substantially cylindrical profile.

17. The locator as set forth in claim 1, wherein the annulus seat is manufactured from a material having a higher hardness than the cylinder head.

* * * * *